US011992738B2

(12) United States Patent
Freuler

(10) Patent No.: US 11,992,738 B2
(45) Date of Patent: May 28, 2024

(54) GOLF BALL MARKER WITH ROTATING TARGET AIMING DEVICE

(71) Applicant: GALAXG LLC, Las Vegas, NV (US)

(72) Inventor: Gregory Freuler, Las Vegas, NV (US)

(73) Assignee: GALAXG LLC, Clackamas, OR (US)

( * ) Notice: Subject to any disclaimer, the term of this patent is extended or adjusted under 35 U.S.C. 154(b) by 221 days.

(21) Appl. No.: 17/421,356

(22) PCT Filed: Jan. 29, 2020

(86) PCT No.: PCT/US2020/015700

§ 371 (c)(1),
(2) Date: Jul. 7, 2021

(87) PCT Pub. No.: WO2020/160162

PCT Pub. Date: Aug. 6, 2020

(65) Prior Publication Data

US 2022/0088448 A1 Mar. 24, 2022

Related U.S. Application Data

(60) Provisional application No. 62/918,473, filed on Jan. 31, 2019.

(51) Int. Cl.
*A63B 57/30* (2015.01)
*A63B 57/50* (2015.01)
(Continued)

(52) U.S. Cl.
CPC ..... *A63B 57/353* (2015.10); *A63B 57/50* (2015.10); *A63B 69/3676* (2013.01);
(Continued)

(58) Field of Classification Search
CPC .... A63B 57/353; A63B 57/50; A63B 69/3676
See application file for complete search history.

(56) References Cited

U.S. PATENT DOCUMENTS 1,521,980 A 1/1925 Zook
1,549,271 A 8/1925 Larson
(Continued)

OTHER PUBLICATIONS

International Search Report and Written Opinion for International Application No. PCT/US2020/015700, dated Apr. 16, 2020, 13, pages.

*Primary Examiner* — Steven B Wong
(74) *Attorney, Agent, or Firm* — Ganz Law, PC

(57) ABSTRACT

A combination ball marker and alignment device has a base and an aiming device. The base has a top surface and an opposing bottom surface. The base further has a ball contact side, disposed on a sidewall between the top and bottom surfaces, having a shape configured to contact a spherical ball along a surface line of the ball that is orthogonally oriented with a vertical axis of the ball, and an opposing back side disposed between the top and bottom surfaces. The aiming device includes a linear indicator. The aiming device is coupled to the base and configured to move along an arcuate path above the top surface. The arcuate path defines an axis rotation, and the linear indicator remains radially oriented to the axis of rotation regardless of the position of the aiming device on the arcuate path.

18 Claims, 29 Drawing Sheets

(51) Int. Cl.
*A63B 69/36* (2006.01)
*A63B 71/06* (2006.01)

(52) U.S. Cl.
CPC .. *A63B 71/0622* (2013.01); *A63B 2071/0694* (2013.01); *A63B 2209/08* (2013.01)

(56) References Cited

U.S. PATENT DOCUMENTS

| | | | | | |
|---|---|---|---|---|---|
| 4,005,870 | A * | 2/1977 | Grace | A63B 69/3676 | 473/409 |
| 4,242,801 | A | 1/1981 | Ellison | | |
| 4,260,151 | A * | 4/1981 | Weaver | A63B 69/3676 | 33/283 |
| 4,960,278 | A | 10/1990 | Hainey | | |
| 5,662,535 | A * | 9/1997 | Smith | A63B 69/3676 | 473/404 |
| 5,792,015 | A * | 8/1998 | Hoyt | G01C 9/12 | 33/391 |
| 10,596,430 | B1 * | 3/2020 | Paavola | A63B 57/207 | |
| 2006/0073916 | A1 * | 4/2006 | Lin | A63B 69/3676 | 473/404 |
| 2009/0118035 | A1 | 5/2009 | Roenick | | |
| 2013/0291393 | A1 | 11/2013 | Fuller | | |
| 2019/0366171 | A1 * | 12/2019 | Jacques | A63B 57/353 | |
| 2021/0268351 | A1 * | 9/2021 | Gardner | A63B 57/353 | |

* cited by examiner

GOLF BALL MARKER WITH ROTATING TARGET AIMING DEVICE

FIELD

The inventive subject matter disclosed in and contemplated by this application (referred to as the "disclosure") generally concerns the sport of golf and devices to mark a position of a ball on the green and to aid in aligning a putting stroke with a target line or path from the ball to the hole. More particularly, but not exclusively, this disclosure pertains to marking the position of a ball on the green with a device that provides a visualization aid for determining the target line/path for a putt, and methods of use.

BACKGROUND INFORMATION

In the sport of golf, striking the golf ball with a golf club at a particular point on the ball with a particular swing trajectory is critical to causing the ball to travel on a path toward the hole. Golfers may use markings on their golf ball as an aiming device to choose the correct line or path for the ball to travel and enter the hole. For example, many golf balls have names or graphical markings printed on them around an equator of the ball, which may be used as an alignment line for aiming. Some devices allow the golfer to apply a straight line around an equator of the ball using a marking pen.

Still other devices, known as "markers" or "ball markers", are available to allow a golfer to mark the position of a golf ball on the playing surface so that the ball can be lifted from the surface, for example, if a ball is in the path of another player's ball on the putting green, and then replaced in the same position. These devices may have added straight lines bisecting the marker, which can be used to create a visualization aid for the line or path of the ball. When the player replaces their ball, they may align the line on the ball with the line on the marker to provide a visual aid for aiming their putt.

These conventional solutions for ball marking, path visualization, and aiming, in combination with the Rules of Golf that are currently in effect, have the potential to add cumbersome steps to the process of alignment, particularly if the player has misjudged their target line and wishes to change to a new target line.

In such a scenario, it would be against the Rules of Golf to merely move the marker because the ball must be replaced at its original position if marked and lifted. If a player using a lined marker visualizes their target line and finds it is not the same as their original target line, simply rotating the marker to a new target line and then replacing the ball in alignment with the new target line would result in a changed ball position. To keep within the rules of golf, under the above scenario the player must 1) replace the ball, 2) reposition the marker, then 3) reposition the ball accordingly. If the player changes their intended line again, these steps would need to be repeated for each change. These steps may add to the playing time. They may lead to off-target putts or strokes. The process may slow the pace of the game. The repetition of the steps may cause strain on the player's body, e.g., to the back, knees or legs.

Accordingly, there is a significant need for improved ways to mark a golf ball in play and to identify and indicate a target line for a golf stroke, e.g. for a putt.

SUMMARY

This disclosure addresses the foregoing and other needs in various embodiments

In view of the limitations presented in the prior art, the inventive concepts provide new and useful solutions to the identification and adjustment of a target line without slowing down the speed of play, while allowing players to conform to the Rules of Golf.

In one possible embodiment, the inventive subject matter is directed to a ball marker comprising a base. The base has a top surface and an opposing bottom surface. The base further has a ball contact side, disposed on a sidewall between the top and bottom surfaces, having a shape configured to contact a spherical ball along a surface line of the ball that is orthogonally oriented with a vertical axis of the ball, and an opposing back side disposed between the top and bottom surfaces. The ball marker further has an aiming device comprising a linear indicator, coupled to the base and configured to move along an arcuate path above the top surface. The arcuate path defines an axis of rotation, and the linear indicator remains radially oriented to the axis of rotation regardless of the position of the aiming device on the arcuate path.

The bottom surface of the base may have one or more traction elements configured to increase friction with a ground surface when the bottom surface contacts the ground surface, or to detachably affix the ball marker to the ground surface.

The base may have an arcuate channel disposed between the ball contact side and the opposing back side, that defines the arcuate path and the axis of rotation. The arcuate channel may extend from the top surface toward the bottom surface, and the aiming device may be moveable within the arcuate channel. The aiming device may have a direction arm having a radial length. The linear indicator may be disposed on a top surface of the direction arm along the radial length. A channel post may be coupled to a bottom surface of the direction arm, where the channel post extends from the direction arm into the arcuate channel and is moveable therein. A receiver may be coupled to the channel post and be configured to permit the channel post to move in the arcuate channel and to prevent the aiming device from decoupling from the base.

The channel post may be coupled to the direction arm at one end of the radial length, at a position disposed away from an end of the radial length, or at a position in the middle of the radial length.

The arcuate channel may extend completely through the base between the top and bottom surfaces of the base. The channel post may extend through the arcuate channel, and the receiver may be coupled to the channel post below the arcuate channel.

The opposing back side of the base may be curved and have the same axis of rotation as the arcuate path. The aiming device may have a curve guide flange that extends from a bottom surface of the aiming device and that is configured to move with respect to an outside of the opposing back side of the base when the aiming device is moved along the arcuate path.

The ball contact side may have a concave shape. The concave shape may be curved and may define an axis of rotation that is the same as the axis of rotation of the arcuate path.

The base may include a textured component disposed on the bottom surface of the base that is removably attachable to the bottom surface of the base. The textured component may have at least one textured surface. The textured component may be a second ball marker. The textured component may have a second ball contact side having a shape configured to contact a spherical ball along a surface line of the ball.

The bottom surface of the base may have a recess configured to house the textured component such that, when the ball marker device is placed on a playing surface, the textured surface contacts the playing surface. The recess may have an open side configured to permit the textured component to be slid in and out of the recess through the open side.

The aiming device may be configured not to contact the ball when the ball is in contact with the ball contact side.

The aiming device may include a pitch mark repair tool.

The ball contact side may be configured to contact a standard golf ball.

In another possible embodiment, the inventive subject matter is directed to a method of making a ball marker that includes providing a base comprising a top surface and an opposing bottom surface; a ball contact side, disposed on a sidewall between the top and bottom surfaces, having a shape configured to contact a spherical ball at two or more positions on the ball; and an opposing back side disposed between the top and bottom surfaces. The method may further include providing an aiming device comprising a direction arm and a linear indicator disposed on a top surface of the direction arm; and coupling the aiming device to the base, wherein the coupled aiming device is configured to move along an arcuate path above the top surface of the base, wherein the arc defines an axis of rotation, and wherein the linear indicator remains radially oriented to the axis of rotation regardless of the position of the aiming device on the arcuate path.

The foregoing and other features and advantages will become more apparent from the following detailed description, which proceeds with reference to the accompanying drawings.

BRIEF DESCRIPTION OF THE DRAWINGS

Referring to the drawings, wherein like numerals refer to like parts throughout the several views and this specification, aspects of presently disclosed principles are illustrated by way of example, and not by way of limitation.

DETAILED DESCRIPTION

Figure 1:
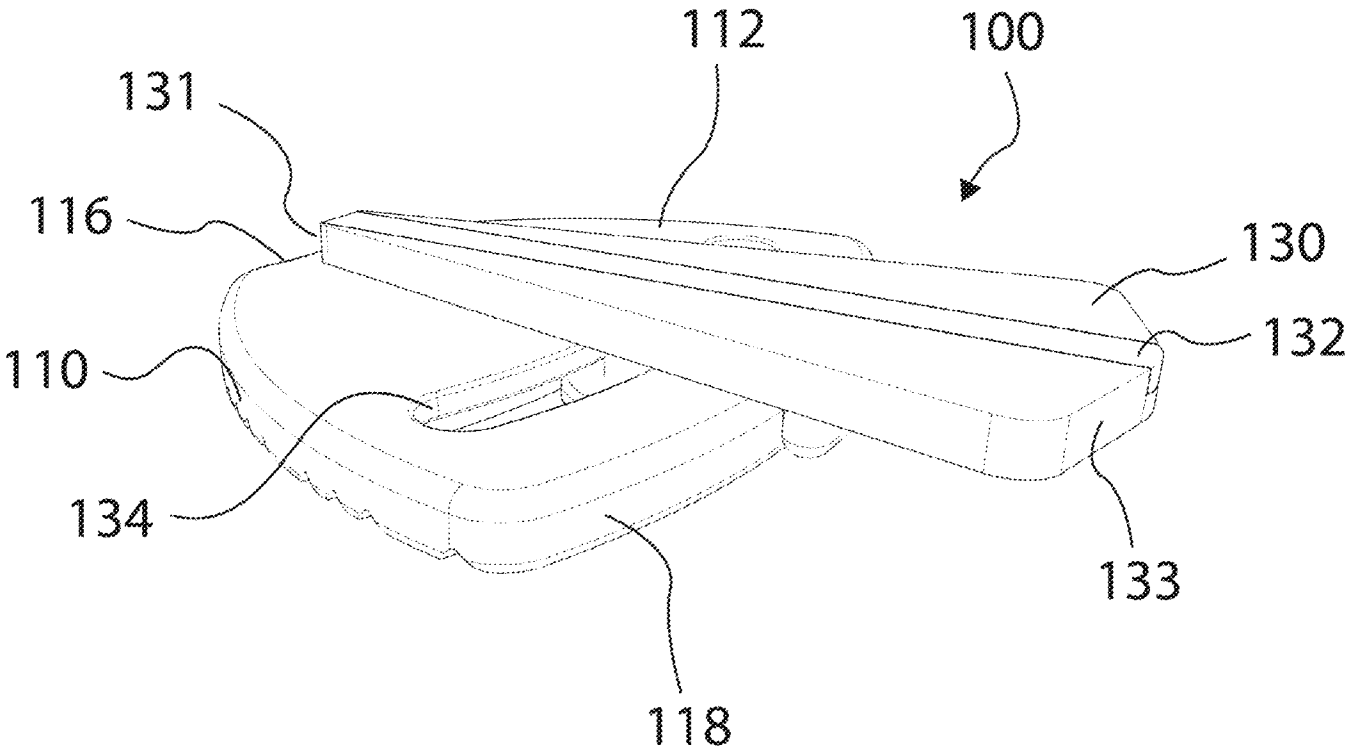
FIG. 1 illustrates a top view of a ball marker.

The following describes various principles related to golf ball markers and aiming devices. For example, some disclosed principles pertain to a combined golf ball marker and aiming device that is configured to consistently replace the ball to an original position on a playing surface. The marker includes an integrated aiming device configured to swing through a horizontal arcuate path so that the aiming device indicates a linear path toward a target elsewhere on the playing surface, without having to move the combined golf ball marker and aiming device.

As but one illustrative example, a combined golf ball marker and aiming device may include a base comprising a top surface and an opposing bottom surface. The base may include a ball contact side disposed on a sidewall between the top and bottom surfaces, having a shape configured to contact a spherical ball along a surface line of the ball that is orthogonally oriented with a vertical axis of the ball. The base may further include an opposing back side disposed between the top and bottom surfaces. The device may include an aiming device, having a linear indicator, that is coupled to the base. The aiming device may be configured to move along an arcuate path above the top surface of the base. The arcuate path defines an axis of rotation, and the linear indicator remains radially oriented to the axis of rotation regardless of the position of the aiming device on the arcuate path. The axis of rotation may align with the center of a golf ball when the device is in contact with the gold ball.

Descriptions herein of specific combined golf ball marker and aiming devices, and specific combinations of method acts, are but particular examples of contemplated products and methods chosen as being convenient illustrative examples of disclosed principles. One or more of the disclosed principles can be incorporated in various other products and methods to achieve any of a variety of corresponding, desired characteristics. Thus, a person of ordinary skill in the art, following a review of this disclosure, will appreciate that products and methods having attributes that are different from those specific examples discussed herein can embody one or more presently disclosed principles, and can be used in applications not described herein in detail. Such alternative embodiments also fall within the scope of this disclosure.

I. Overview—Rules of Golf

The Rules of Golf ("the Rules"), as promulgated by the United States Golf Association (USGA) and Royal & Ancient (R & A), the two worldwide governing bodies of the rules of golf, permit a player to place a marker on the playing surface, e.g., on a putting green, to indicate the position of a golf ball in play and to remove the ball from the playing surface. A player might choose to lift the ball from the playing surface, e.g., to clean the ball, or to remove the ball from another player's putting path. According to the Rules, the ball must be replaced in the same position when put back in play, e.g., as indicated by the marker. Rules of Golf 13.1b. A marker may be "[a]n artificial object . . . used to mark the spot of a ball to be lifted, such as a tee, a coin, an object made to be a ball-marker or another small piece of equipment." Rules of Golf, Definitions. Conventionally, markers may include generally low-profile disc-shaped objects, coins, or any other small objects.

Figure 14:
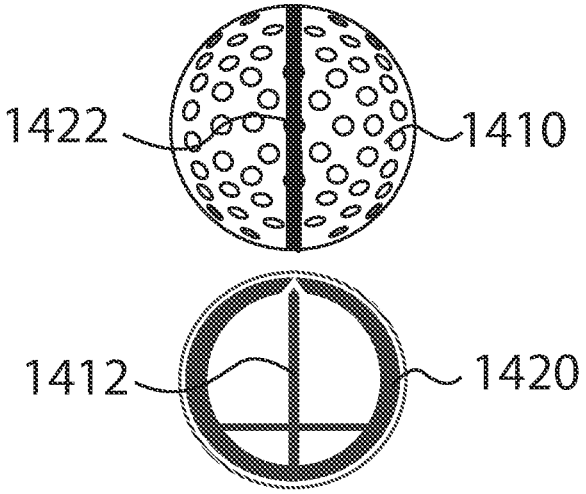
FIG. 14 illustrates a conventional ball marker and a marked ball.

Some markers include alignment aids, such as one or more horizontal lines on the surface of the marker. If the player aligns the marker's alignment aid with a path to a desired target, e.g., to the hole, and then aligns a line on the ball with the alignment aid, the direction of the stroke may be indicated by the line on the ball. FIG. 14 illustrates a golf ball 1410 in place on a playing surface and a conventional marker 1420 placed behind the ball relative to a target. The marker 1420 includes an alignment aid, e.g., line 1412. The golf ball 1410 may also include an alignment line 1422. The line 1422 may be a component of the golf ball as sold, e.g., as a graphic, a logo, or a line of text, or may be added by the player with a conventional ball marking tool. As shown, the line 1422 and the alignment aid 1412 are in alignment and represent a visualization of the player's intended path for the ball. Once the ball is placed back in its original position aligned with the alignment aid of the marker 1420, and the marker is removed, the player may then strike the ball with a club, e.g., using a putting stroke, in the direction indicated by the line on the ball.

Figure 15A:
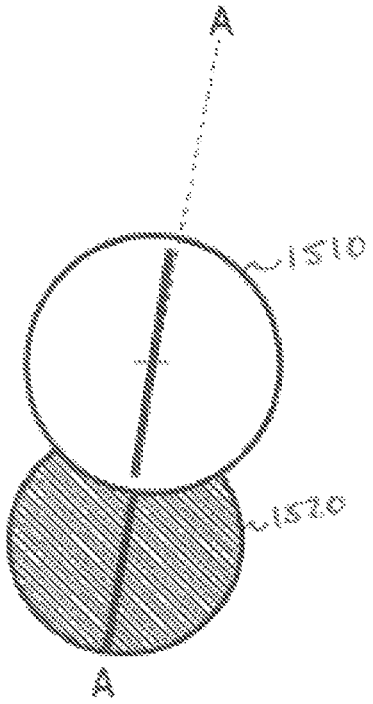
FIG. 15A-C illustrates an alignment process with a conventional marker that is non-compliant with the Rules of Golf.
Figure 15B:
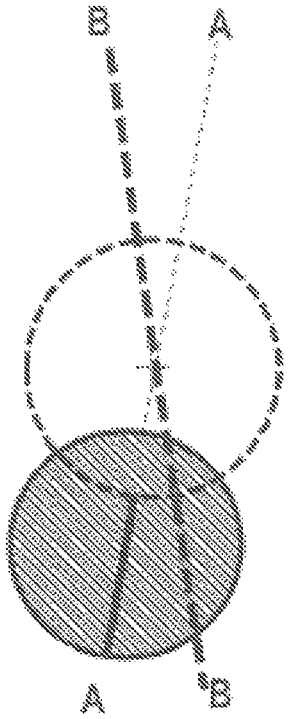
Figure 15C:
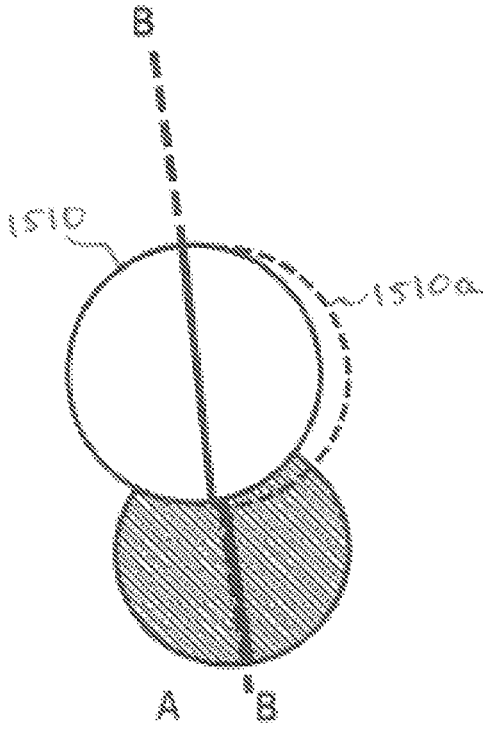

However, in some cases, after the marker is placed and the ball is lifted, the player may realize that their original target line is incorrect and may wish to change the orientation of the alignment aid on the marker. FIG. 15A shows a ball 1510 aligned with a marker 1520 along a target line A. In FIG. 15B, upon lifting the ball, the player may decide that target line A is undesirable and may wish to change the orientation of the alignment aid, e.g., to align with target line B. Merely rotating the marker in place to change the orientation of the alignment aid from target line A to target B could, however, cause a violation of the Rules. As shown in FIG. 15C, the marker is rotated such that its alignment aid aligns with target line B. If the ball is replaced, as shown, so that the line on the ball aligns with the alignment aid on the re-oriented marker as shown, the ball 1510 is no longer in its original location 1510*a*, thereby violating the Rules. If the ball were replaced in its original location, it would no longer align with the re-oriented marker, defeating the purpose of the alignment aid.

Figure 16A:
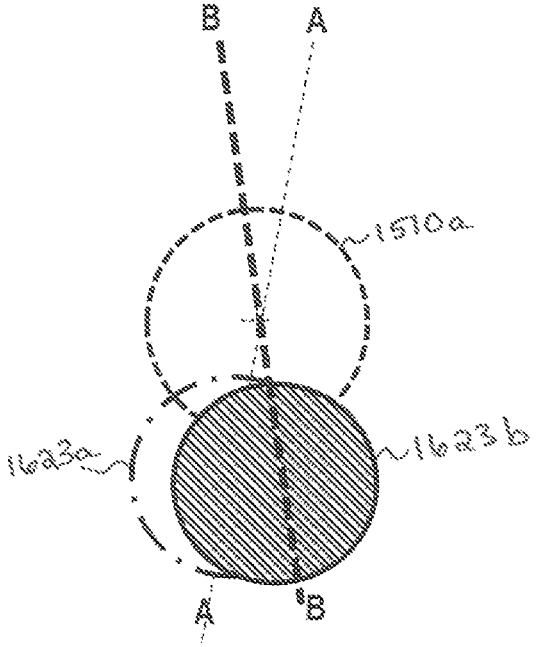
FIG. 16A-B illustrates an alignment process with a conventional marker that is compliant with the Rules of Golf.
Figure 16B:
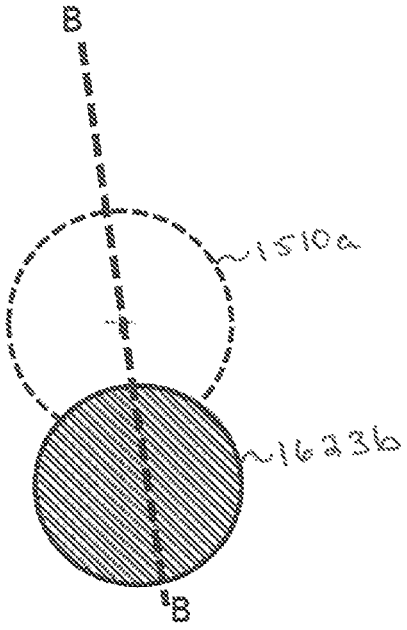

Thus, to comply with the Rules, and as shown in FIGS. 16A-B, the player would need to replace the ball in its original position 1510*a* on the playing surface. The player would then remove the marker from its first position indicated by circle 1623*a* and reposition the marker to a second position, indicated by circle 1623*b*, so that its alignment aid aligns with the desired aiming direction, e.g., as shown by line B. The player would then lift the ball again to allow the other player(s) to putt. At the player's turn, the player may reassess their aiming line again prior to putting. This slows down the pace of play, and causes the player to have to bend over, or otherwise reach the ground, repeatedly. This process must be repeated each time the player changes their desired aiming direction for a given shot.

Figure 17A:
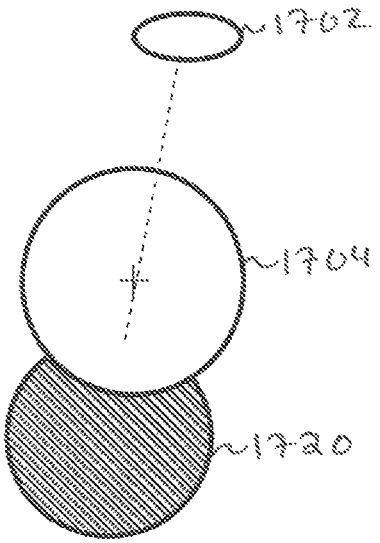
FIG. 17A-C illustrates a marking and ball placement process that is non-compliant with the Rules of Golf.
Figure 17B:
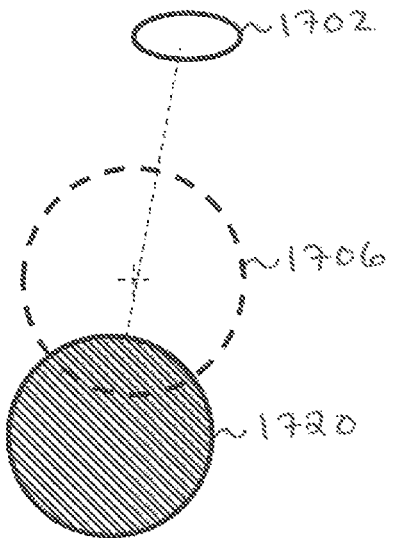
Figure 17C:
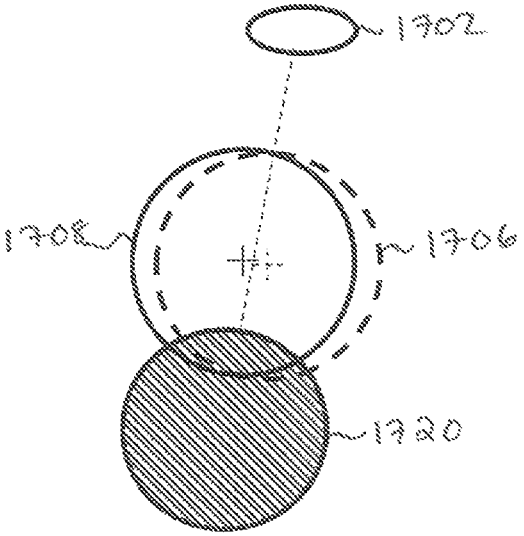

A disadvantage of circular conventional markers is illustrated in FIGS. 17A-C. Circular conventional markers may also cause inadvertent violation of the Rules when the player replaces the ball. A circular marker may allow the ball to be replaced in a different position because there are no features on the circumference of the circular marker that serve to hold the ball in a singular position. For example, in FIG. 17A, the player has placed a marker 1720 behind the ball 1704 relative to a target 1702. The marker is relatively flat and can be positioned such that the ball overlaps the marker even while the marker is in contact with one point on the ball. In FIG. 17B, the ball is lifted, and its original position is indicated by circle 1706. In FIG. 17C, the player has replaced the ball in a new position 1708. To the player, position 1708 may appear to the same as position 1706, but the positions are different, thus violating the Rules. There is no feature on a round marker that ensures that the ball is replaced in the same position.

Figure 18:
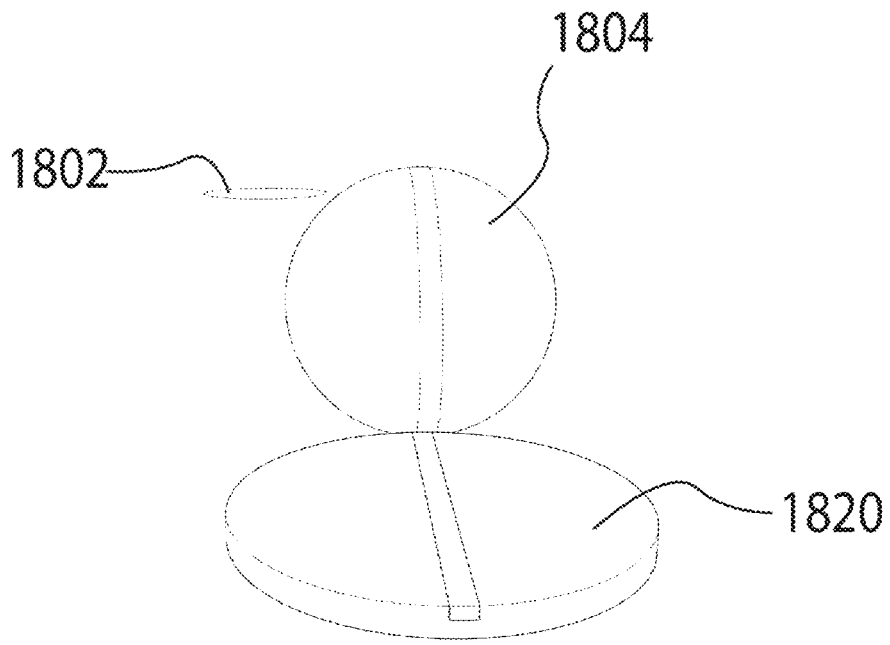
FIG. 18 illustrates an obscured sight line when using a conventional marker.

Another disadvantage of conventional ball markers with alignment aids is illustrated in FIG. 18. When a player initially places a conventional marker 1820 prior to lifting the ball 1804, and attempts to align the alignment aid on the marker with an intended target line, the ball may obscure the view from the marker to the target 1802. This arrangement may cause inaccurate readings of the target line.

II. Ball Marker and Alignment Devices

The following disclosure pertains to embodiments of an inventive combination ball marker and aiming or alignment device, referred to herein as a "ball marker". The disclosed embodiments of the ball marker overcome the disadvantages of conventional ball markers and alignment aids, as discussed above, and may provide additional advantageous features.

Figure 2:
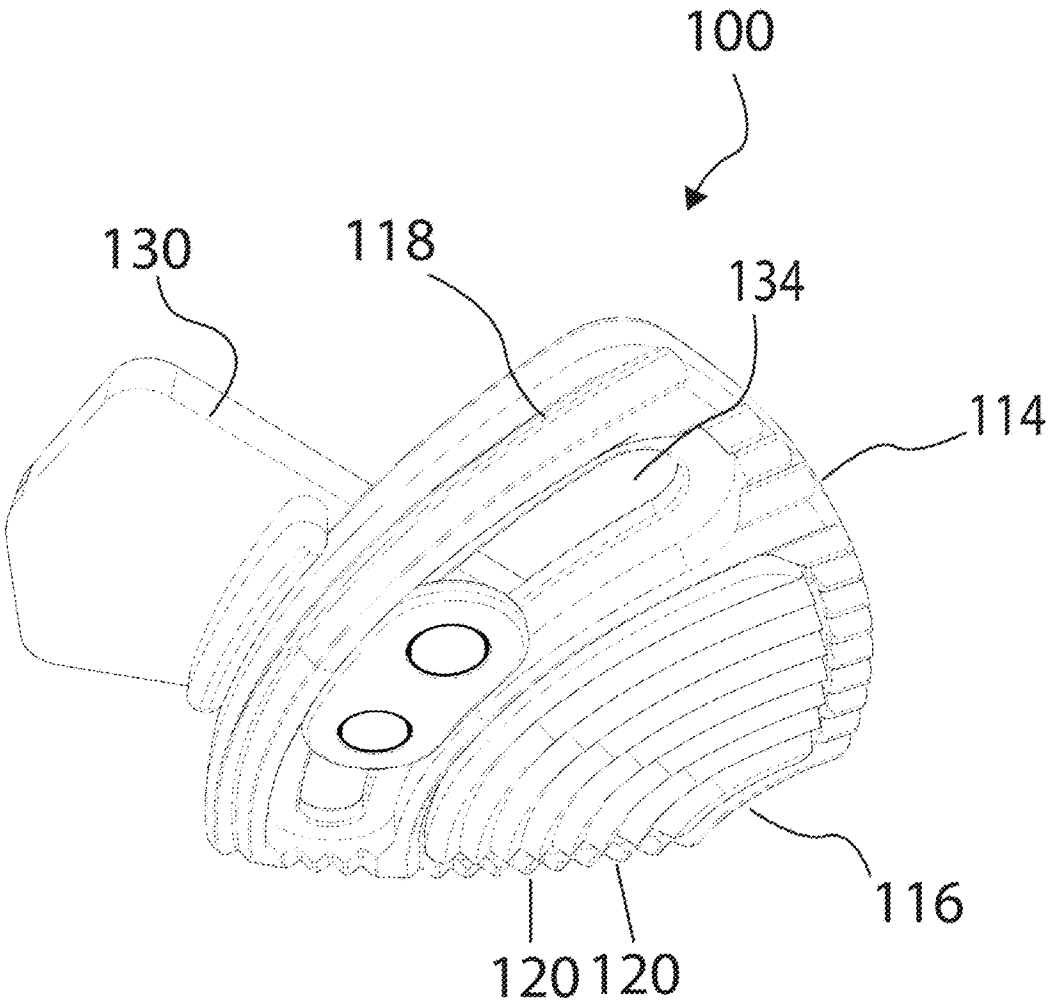
FIG. 2 illustrates a bottom view of the ball marker of FIG. 1.

FIG. 1 shows a top elevation of an embodiment of a ball marker 100, which may be a combination ball marker and alignment device. FIG. 2 shows a bottom elevation of the ball marker 100.

The ball marker 100 may include a base 110 and an aiming device 130.

The base 110 may include a top surface 112 and an opposing bottom surface 114. The base may include a ball contact side 116 that is disposed on a sidewall between the top and bottom surfaces. The base may include an opposing back side 118, disposed between the top and bottom surfaces. The ball contact side 116 may be substantially perpendicular to the top surface 112.

In one embodiment, the top surface 112 may be substantially parallel to the bottom surface 114 of the base. That is, when the ball marker 100 is placed on a level, flat surface, the top surface 112 is also level and flat. In other embodiments, the top surface 112 may be angled relative to the bottom surface, for example, the top surface at the back side 118 may be higher relative to the level flat surface than the top surface at the ball contact side 116.

The bottom surface 114 of the base may include one or more traction elements 120. In an embodiment, the traction elements may be configured to increase friction with a ground surface, e.g., the playing surface, when the bottom surface contacts the ground surface. The traction elements may include, for example, ridges, nubs, or teeth, or a combination thereof. In another embodiment, the traction elements may include one or more spikes that can be inserted into the ground surface so as to detachably affix the ball marker to the ground surface. The traction elements may be disposed along one or more peripheral edges of the bottom surface and/or on portions of the bottom surface internal to the peripheral edges.

Figure 3:
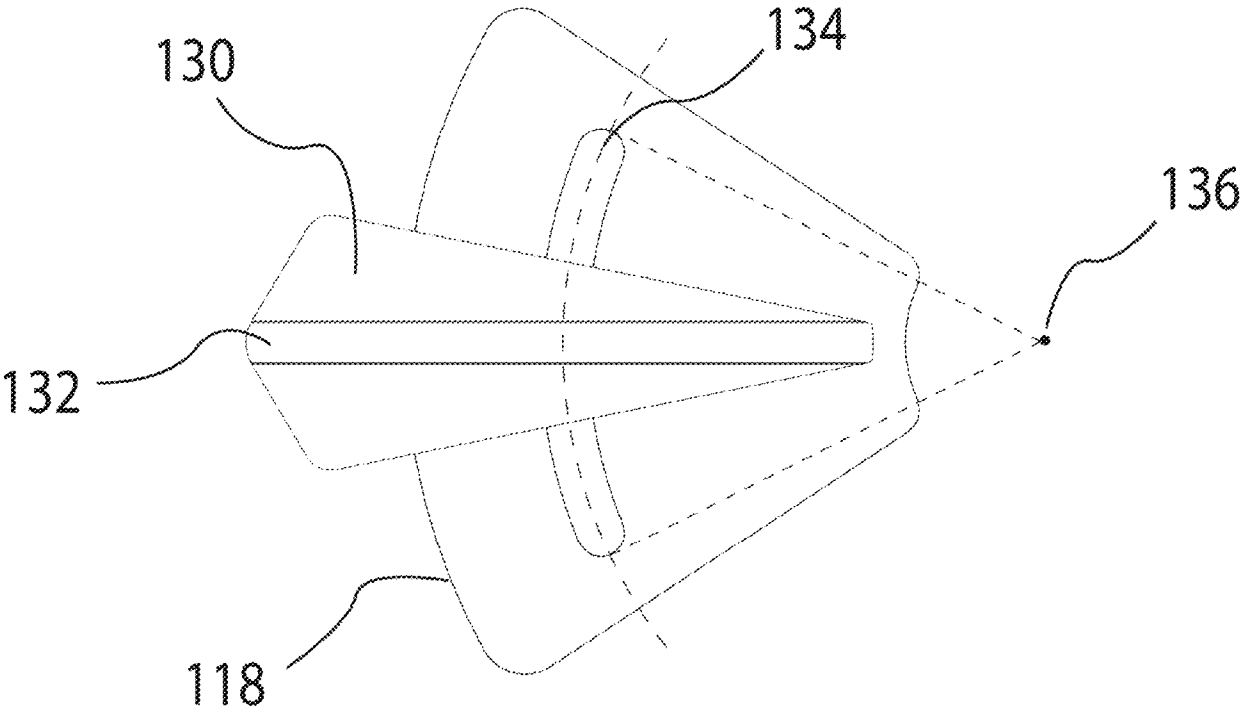
FIG. 3 illustrates an arcuate path on the ball marker of FIG. 1.

The aiming device 130 may be coupled to the base above the top surface and configured to move along an arcuate path 134. As used herein, "arcuate" means curved. The curve of the arcuate path may, for example, correspond to a part of a circle, a parabola, a peak or trough of a sinusoidal wave, or an ellipse. The aiming device 130 may include a linear indicator 132. As seen in FIG. 3, the arcuate path 134 may define an axis of rotation 136. The axis of rotation indicates a point in the plane of the aiming device where radial lines from the arcuate path would converge. The axis of rotation may generally be spaced away from the body of the ball marker 100. The linear indicator 132 may remain radially oriented to the axis of rotation regardless of the position of the aiming device 130 on the arcuate path 134. That is, an imaginary line extending from the linear indicator toward the axis of rotation will intersect the axis of rotation regardless of where the aiming device is on the arcuate path. In other words, a first forward end 131 of the linear indicator moves in a concentric circle with a rear end 133 (as do all points in between the first and second ends).

Returning to FIGS. 1 and 2, the ball contact side 116 may have a shape configured to contact a spherical ball along a surface line of the ball that is orthogonally oriented with a vertical axis of the ball. As used herein, the vertical axis of the ball refers to a line that is orthogonal to the playing surface at the position of the ball and that intersects the center of the ball.

The ball contact side 116 may be, for example, notched or concavely curved. In a notched configuration, the ball contact side 116 may contact the ball at the ends of the notch. In a concavely curved configuration, some or all of the ball contact side 116 may contact the ball. In some embodiments, the ball contact side has a curvature that matches a curvature on the ball and can engage the ball's curvature in a complementary abutment. In some embodiments, the concavely curved ball contact side defines an axis of rotation that is the same as the axis of rotation of the arcuate path. The ball contact side 116 is configured to allow the player to return the ball to the original, marked position consistently, because the notch or curve receives the ball in only one position.

Figure 4:
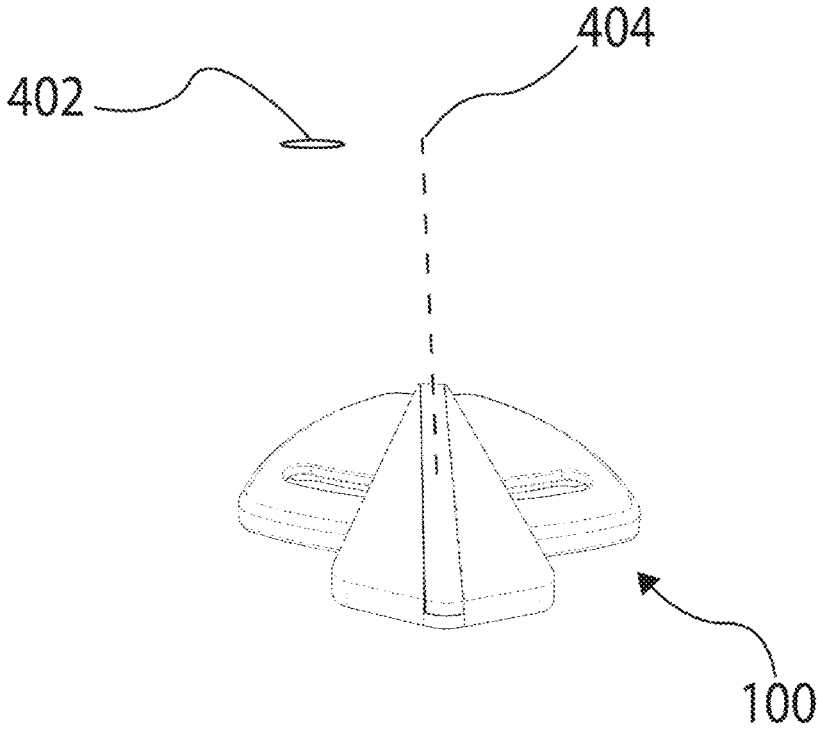
FIG. 4 illustrates a target line sighting.

When the ball contact side 116 is in contact with a standard golf ball, the axis of rotation of the arcuate path may coincide with the vertical axis of the ball. This configuration allows the player to select an intended target line by moving the aiming device 130 relative to the base, without the ball in place on the playing surface or in contact with the ball contact side 116, where it might obscure the player's view of the target. As can be seen. for example, in FIG. 4, this permits an unobstructed view of the target line 404 from the ball marker to the cup or flag line 402. Further, once the ball is replaced in contact with the ball contact side 116, the ball will be in its original, marked position and the linear indicator will effectively point to the vertical axis of the ball. The aiming device may be configured not to contact the ball when the ball is in contact with the ball contact side.

Figure 5:
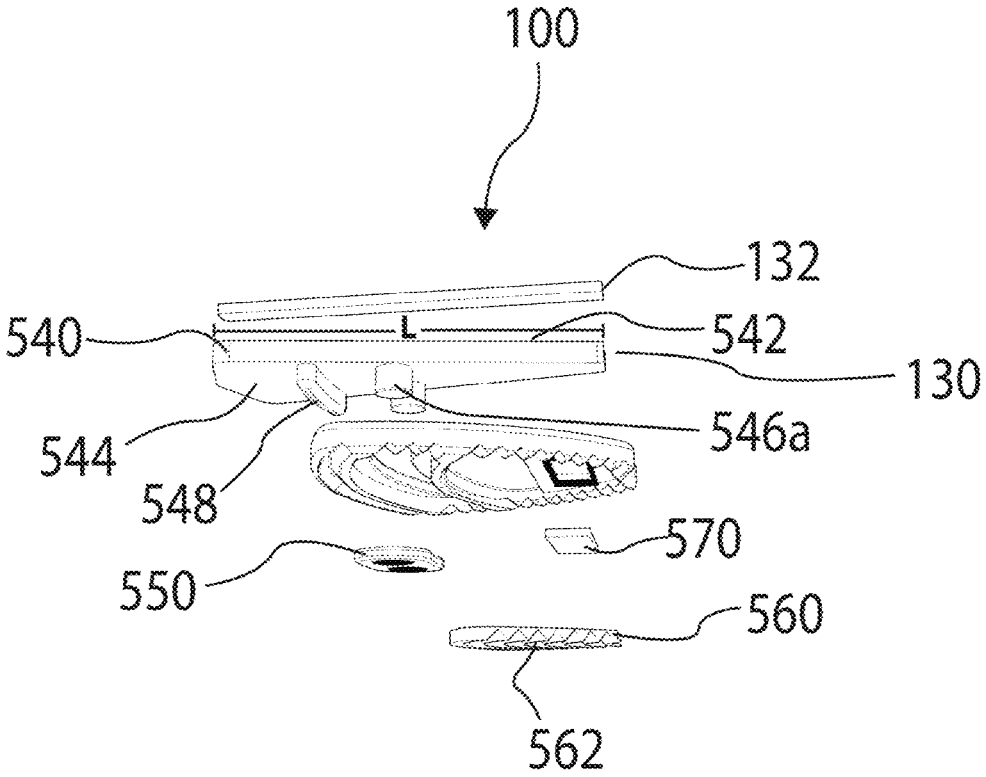
FIG. 5 illustrates an exploded view of the ball marker of FIG. 1.

FIG. 5 shows an exploded view of the ball marker 100. In the illustrated embodiment, the linear indicator 132 is shown exploded from the aiming device 130, and may be, for example, a painted line, a linear graphic adhered to the aiming device 130, e.g., a sticker, or a linear piece of material, e.g., a piece of wood, metal, or plastic adhered or otherwise attached to the aiming device. In other embodiments, the linear indicator 132 may be integral to the aiming device, and may be, for example, a line or a linear pattern engraved or etched onto the top surface 542 of the aiming device, e.g., a set of dots, or an integral raised line or linear pattern. In some embodiments, the linear indicator 132 may have a color or coating that contrasts with the surface 542 of the aiming device. For example, the linear indicator 132 may be a white stripe or a yellow stripe on a black surface, or a reflective stripe on a matte surface.

The aiming device 130 may include a direction arm 540 having a radial length L. The direction arm 540 has a top surface 542 and a bottom surface 544. The linear indicator 132 may be disposed on the top surface 542 along the radial length.

The aiming device 130 may include a channel post 546 coupled to the bottom surface 544 of the direction arm. The channel post 546 may be moveably coupled to the arcuate path. For example, the arcuate path 134 may be a channel or groove in the base 110, and the channel post 546 may extend from the direction arm into the arcuate path 134, and may slide along the arcuate path.

In the illustrated embodiment, the channel post 546 is connected to the direction arm at approximately the mid-point of the radial length of the direction arm 540. In other embodiments, the channel post 546 may be coupled to the direction arm at one end of the radial length, e.g., at the end closest to the ball contact surface, or at the end farthest from the ball contact surface. In still other embodiments, the channel post 546 may be coupled to the direction arm at a position disposed away from an end of the radial length, e.g., somewhere between the mid-point and one of the ends. Regardless of where the channel post is coupled to the direction arm, the aiming device should be able to move along the arcuate path such that the linear indicator remains radially aligned with the axis of rotation of the arcuate path.

Figure 6:
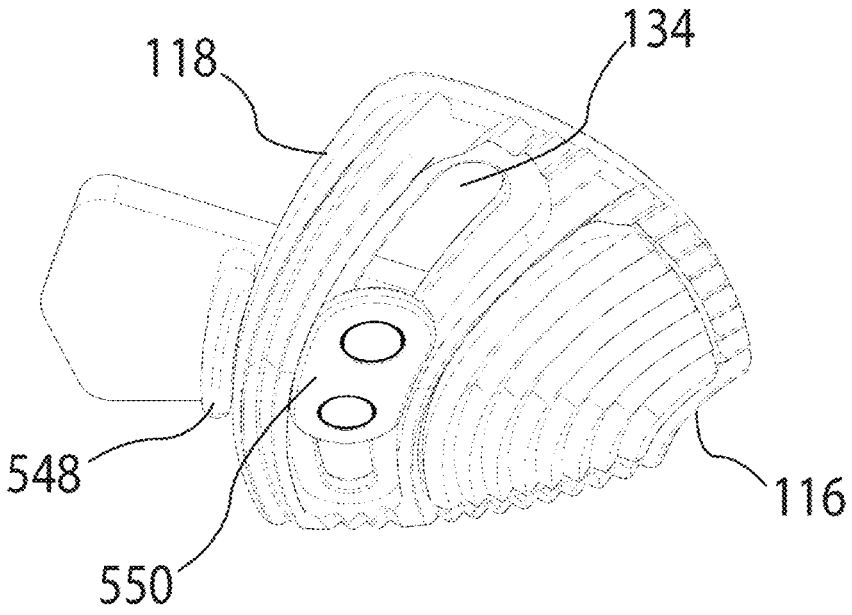
FIG. 6 illustrates a removable textured component and a base of the ball marker of FIG. 1.

The aiming device 130 may include a receiver 550 coupled to the channel post 546. In some embodiments, the channel post may be an integral part of the receiver and may be connectable to the direction arm. The receiver 550 may be configured to permit the channel post 546 to move in the arcuate channel and to prevent the aiming device from decoupling from the base. The receiver may also prevent the aiming device from tilting and misaligning the linear indicator. In the illustrated embodiment, the arcuate path 134 is depicted as a channel that extends entirely through the base from the top surface 112 to the bottom surface 144. As shown in FIG. 6, the arcuate path 134 may be a bossed channel such that the receiver 550 may be recessed into the base. In this configuration, the receiver does not extend below the bottom surface of the base and may be flush with, or recessed from, the bottom surface.

Figure 7:
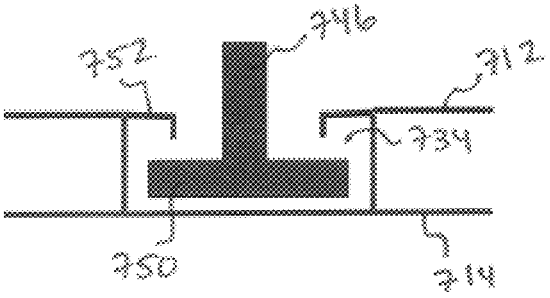
FIG. 7 illustrates a cross section of a second embodiment of an arcuate path.

FIG. 7 illustrates a cross section of an embodiment of an arcuate path 734 that does not extend entirely through the base 714. The arcuate path may include a lip, flange, or shoulder 752 within the channel or groove that may retain the receiver 750 below the top surface 712 while permitting the receiver 750 and the channel post 746 to move within the arcuate path.

As shown in FIGS. 3, 5, and 6, the opposing back side 118 of the base may be curved. The curve may have the same axis of rotation as the arcuate path 134. The aiming device 130 may optionally include a curve guide flange 548 that extends from the bottom surface 544 of the aiming device. The curve guide flange 548 may be disposed radially outward of the back side 118. The curve guide flange 548 may be curved such that when the aiming device is moved along the arcuate path, the curve guide flange 548 can move with respect to the opposing back side 118 of the base. The curve guide flange 548 and the receiver 550 may stabilize the direction arm, for example, by preventing undesirable rotation about the channel post.

In an embodiment, the base 110 may include a textured component 560 disposed on the bottom surface of the base. The textured component 560 may be removably attachable to the bottom surface of the base, e.g., by a magnet 570. The textured component 560 may have at least one textured surface, e.g., textured surface 562.

Figure 8A:
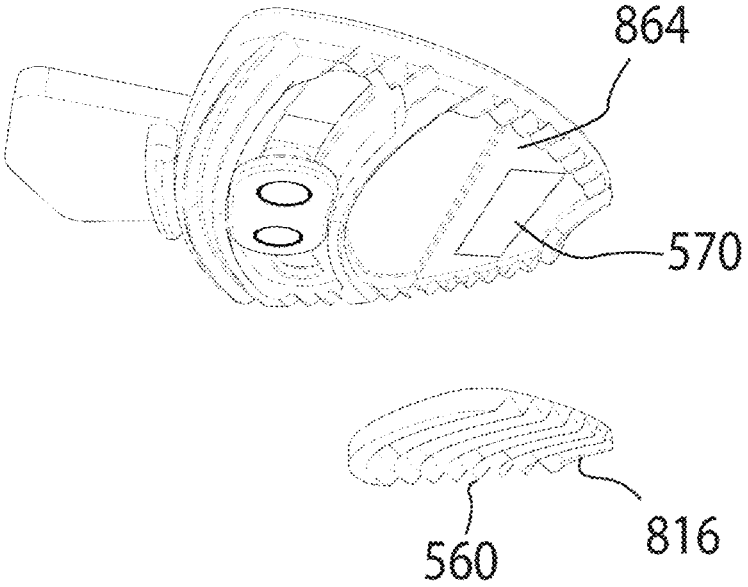
FIG. 8A illustrates the removable textured component of FIG. 6 in a removed state.

As shown in FIG. 8A, the textured component 560 may be a second, separate ball marker, having a second ball contact side 816. The second ball contact side may have a shape configured to contact a spherical ball along a surface line of the ball.

The bottom surface of the base may include a recess 864 configured to house the textured component 560 such that, when the ball marker device 100 is placed on a playing surface, the textured surface contacts the playing surface. The magnet 570 may be disposed in the recess to removably hold the textured component 560. The textured component 560 may be made of a magnetic material, or may have a ferrous component affixed to it to connect to a magnet on the bottom of the base 118, or may have a complementary magnet affixed to its top surface to engage with the magnet 570.

Figure 8B:
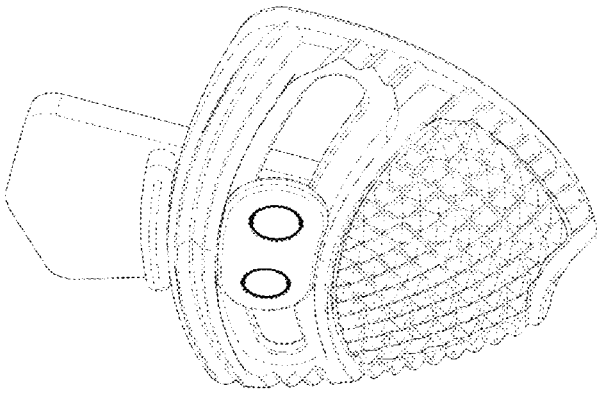
FIG. 8B illustrates a second removable textured component.

In the illustrated embodiment of FIGS. 6 and 8A, the textured component has a textured surface comprised of arcuate ridges. In another embodiment, as shown in FIG. 8B, the textured surface may be comprised of a plurality of teeth. The teeth may be, for example, cylindrical, pyramidal, or conical protrusions from the textured component. The teeth may be arranged in a pattern, e.g., in arcuate rows, linear rows, off-set rows, or concentric circles, or may be randomly arranged.

Figure 9:
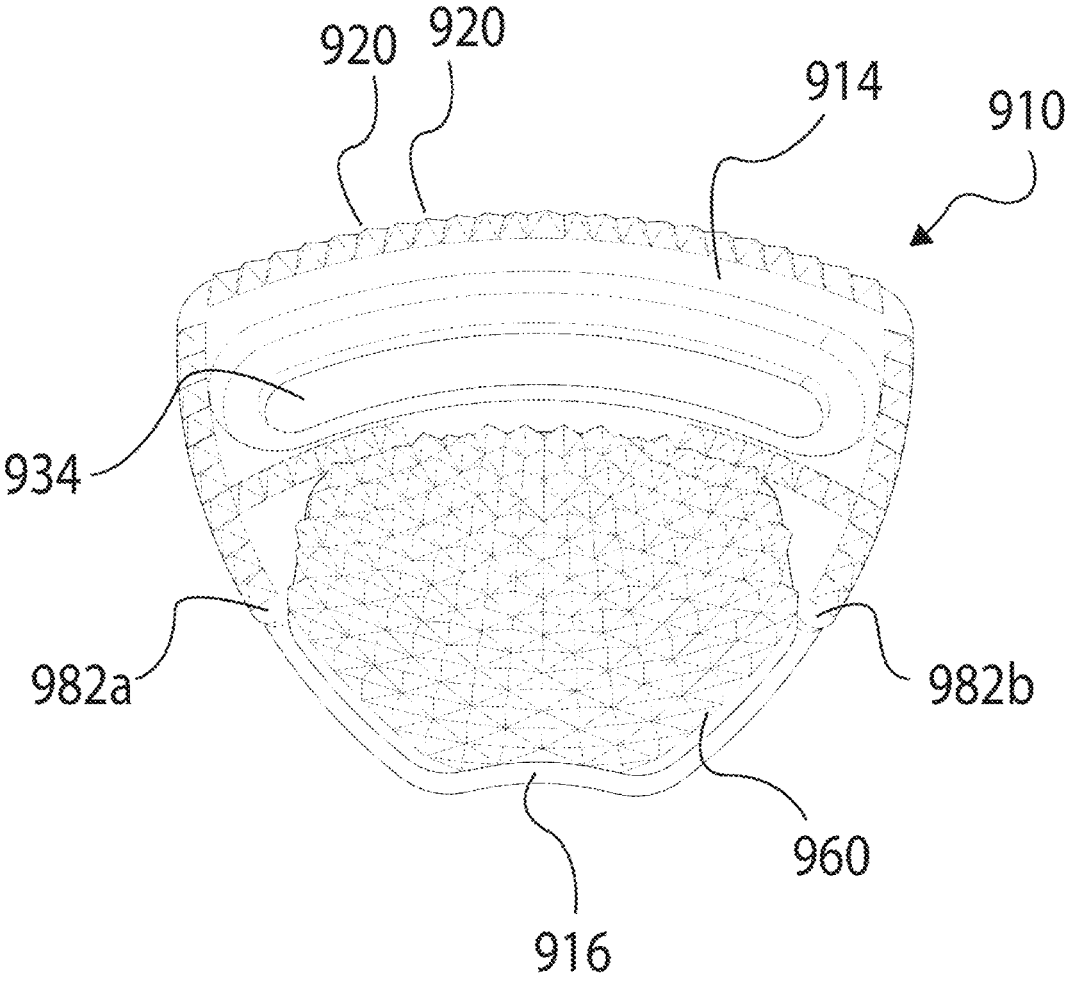
FIG. 9 illustrates a second embodiment of a base and a third removable textured component.

FIG. 9 shows a view of a bottom surface 914 of a base 910 for another embodiment of a ball marker. The base 910 may include an arcuate path 934 and traction elements 920. The base 910 may include a recess configured to house a textured component 960, which may be a removable ball marker.

Figure 10A:
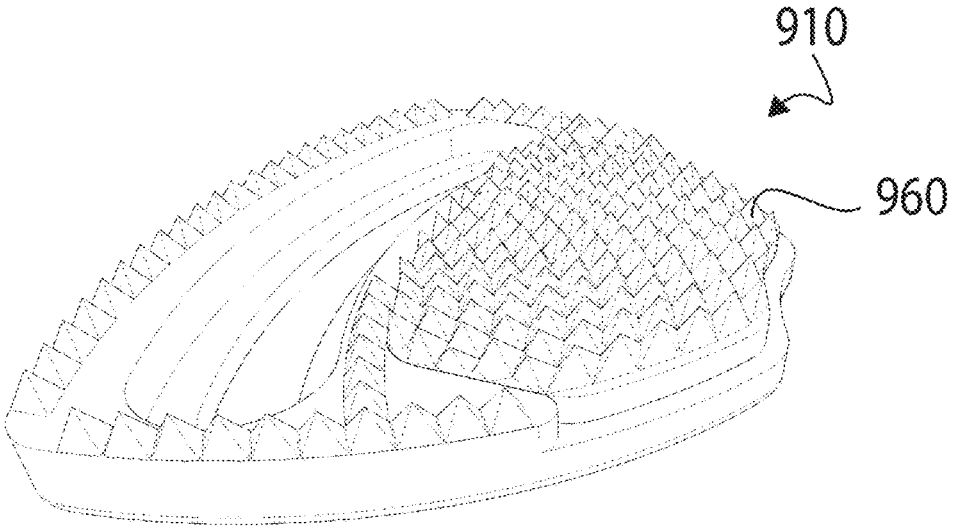
FIGS. 10A-C illustrate a side view of the base of FIG. 9 and a removal of the removable textured component.
Figure 10B:
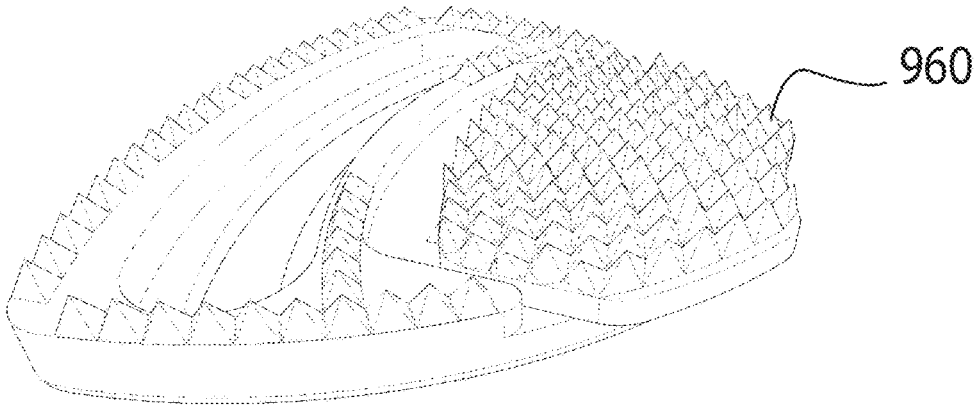
Figure 10C:
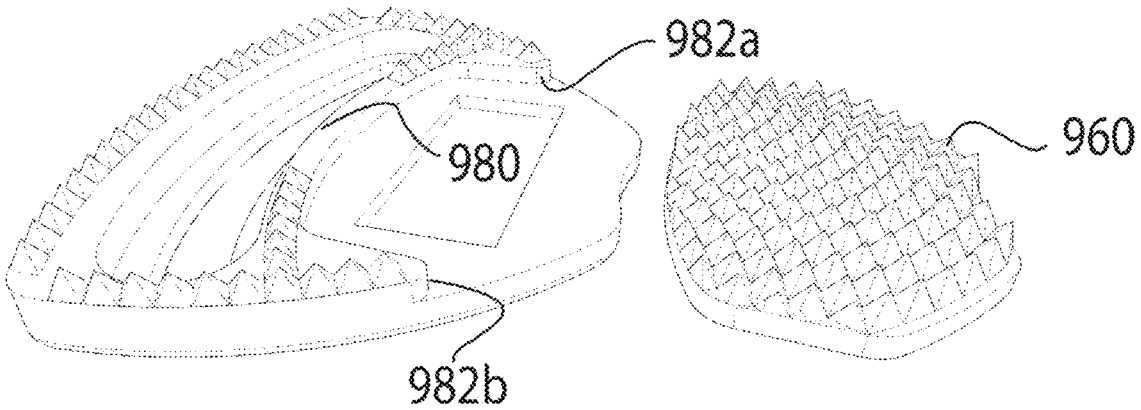

Unlike the embodiments shown in the previous figures, the recess in the base 910 may have an open side configured to permit the textured component 960 to be slid in and out of the recess through the open side and over the ball contact side 916. That is, the recess may be defined by a rear wall 980 and two partial side walls 982*a* and 982*b*, without a corresponding front wall. FIGS. 10A-C illustrate a side view of the textured component 960 in different positions as the textured component 960 is slid away from the base 910.

In various embodiments, the aiming device may have a radial length between 1 and 3 inches, e.g., 1.1", 1.4", 1.7", 2.3", 2.6", or 2.9". The base may be narrower at the ball contact surface than at the opposing back surface. The width at the ball contact surface may be between 0.25" and 1.5", e.g., 0.3", 0.5", 0.7", or 1.2". The width at the back surface may be between 0.5" to 2.5", e.g., 0.7", 0.9", 1.3", 1.6", or 2.1". The height of the ball marker may be between 0.2" and 0.5", e.g., 0.25", 0.3", or 0.4". In order to comply with the Rules, the entire assembly should not exceed 2 inches in any dimension, however, non-compliant devices may be contemplated.

III. Method of Using

The disclosed inventive ball markers thus provide a player with the ability to change an intended target line for a golf stroke by simply moving the aiming device on the ball marker rather than going through a time-consuming multi-step process discussed above with respect to FIGS. 15 and 16. This may improve the player's experience by saving time, speeding up play, and reducing strain and fatigue on the back and legs. The disclosed inventive ball markers also allow the player to select a target line without the ball in place on the playing surface, where it might obstruct the player's sight line to the target.

Figure 11:
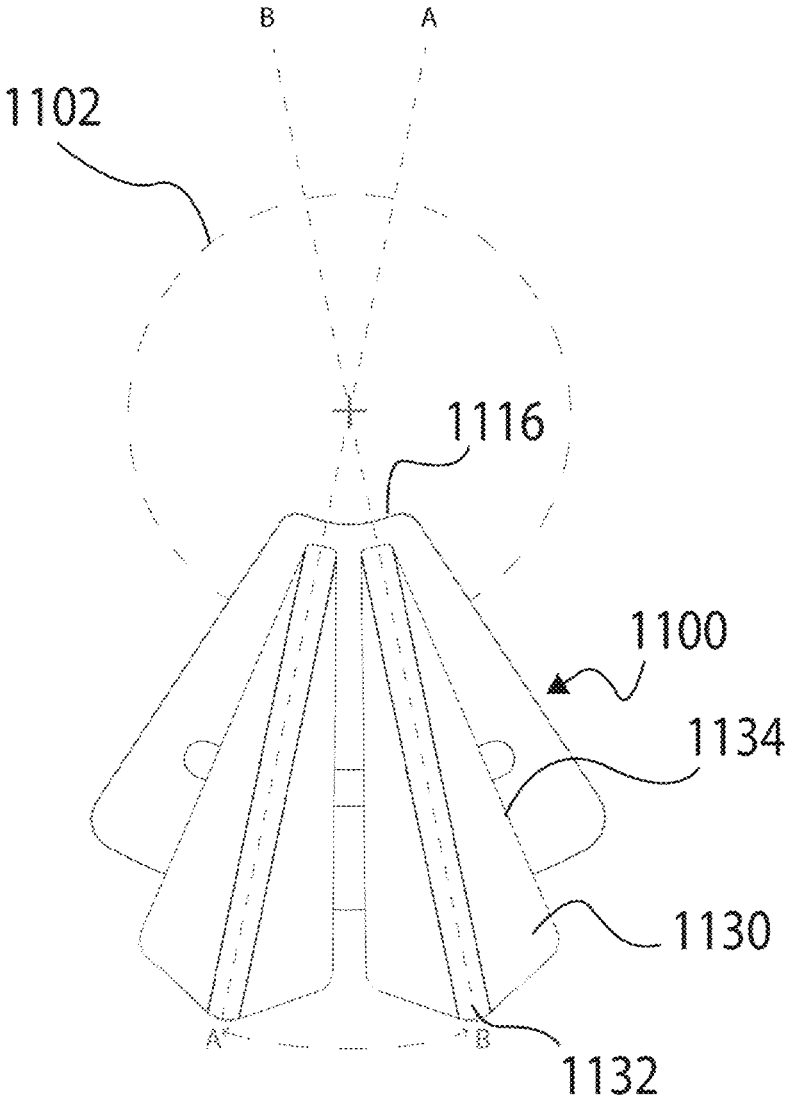
FIG. 11 illustrates an alignment process using the ball marker of FIG. 1.

For example, as shown in FIG. 11, the player may place an inventive ball marker 1100 so that the ball contact surface 1116 is in contact with the ball 1102, and the bottom surface is in contact with the playing surface. The player may then lift the ball 1102, removing it from the playing surface. The player may move the aiming device 1130 along the arcuate path 1134 until the linear indicator 1132 is aligned with a desired target line, e.g., line A or line B. The player can then replace the ball and align a line on the ball with the linear indicator. The ball contact surface 1116 ensures that the ball is positioned in its original location. It is noteworthy that either line A or B intersects with the central vertical axis of the ball 1102. If the player changes their mind about their initial target line, they can simply move the aiming device along the arcuate path to the new target line, and then rotate the ball in place to align with the linear indicator. If an unobstructed view of the target is desired, the player could lift the ball again, without moving the ball marker, and adjust the aiming device.

Unless otherwise noted, devices embodying the claimed and disclosed features have been approved as "Conforming to the Rules of Golf" by both the United States Golf Association (USGA) and Royal & Ancient (R & A), the two worldwide governing bodies of the rules of golf. This 'Conforming' status provides all players, both amateurs and professionals, the ability to use the present invention for casual and tournament play.

IV. Method of Making

A method of making a ball marker may include providing a base comprising a top surface and an opposing bottom surface; a ball contact side, disposed on a sidewall between the top and bottom surfaces, having a shape configured to contact a spherical ball at two or more positions on the ball; and an opposing back side disposed between the top and bottom surfaces; providing an aiming device comprising a direction arm and a linear indicator disposed on a top surface of the direction arm. The base and aiming devices may be made of any relatively rigid material, such as, but not limited to, wood, ceramic, metal, e.g., aluminum or steel, or a rigid plastic. The base and aiming devices may be carved, molded, extruded, or 3-D printed, for example. The method may further include coupling the aiming device to the base. When coupled to the base, the aiming device may be configured to move along an arcuate path above the top surface of the base, wherein the arc defines an axis of rotation, and wherein the linear indicator remains radially oriented to the axis of rotation regardless of the position of the aiming device on the arcuate path.

V. Other Exemplary Embodiments

The examples described above generally various principles related to combination golf ball marker and alignment devices, and methods of use. The previous description is provided to enable a person skilled in the art to make or use the disclosed principles. Embodiments other than those described above in detail are contemplated based on the principles disclosed herein, together with any attendant changes in configurations of the respective apparatus or changes in order of method acts described herein, without departing from the spirit or scope of this disclosure. Various modifications to the examples described herein will be readily apparent to those skilled in the art.

Figure 12:
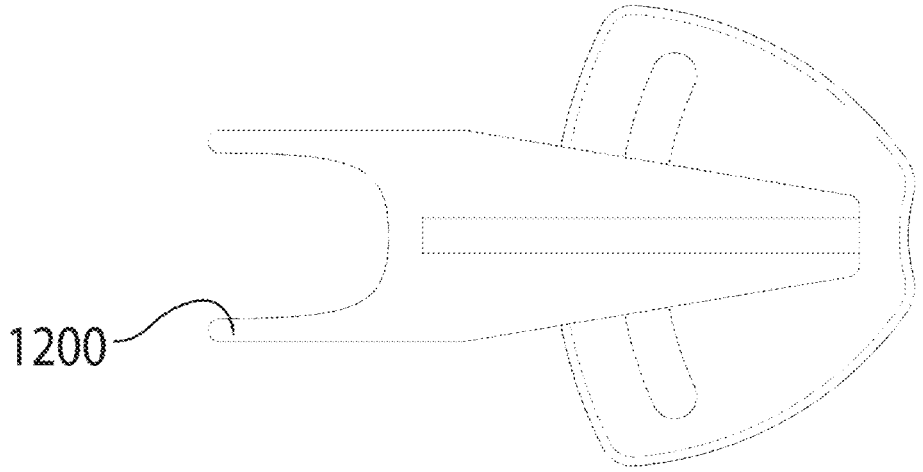
FIG. 12 illustrates an embodiment of an aiming device with a pitch mark repair tool.

For example, an aiming device on ball marker may additionally include a pitch mark repair tool 1200, as shown in FIG. 12. A pitch mark repair tool may be used to repair damage to a putting green from a ball impact.

Figure 13:
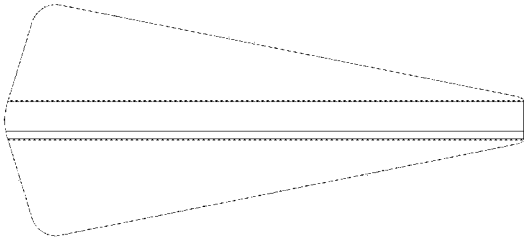
FIG. 13 illustrates an embodiment of a linear indicator.

In some embodiments, the linear indicator may include a plurality of contrasting lines, for example, as shown in FIG. 13.

Figure 19:
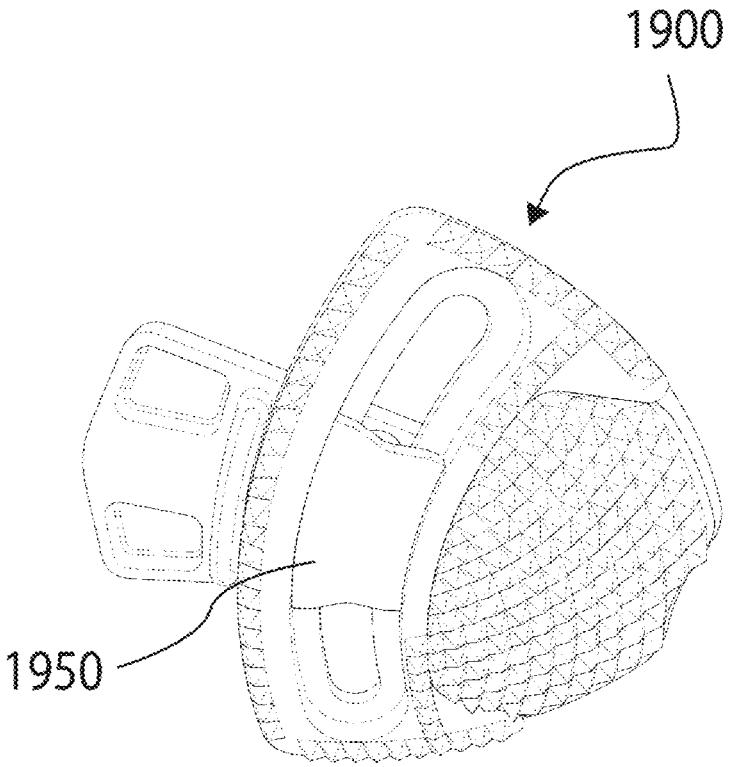
FIG. 19 illustrates an embodiment of a ball marker with an alternate embodiment of a receiver.
Figure 20:
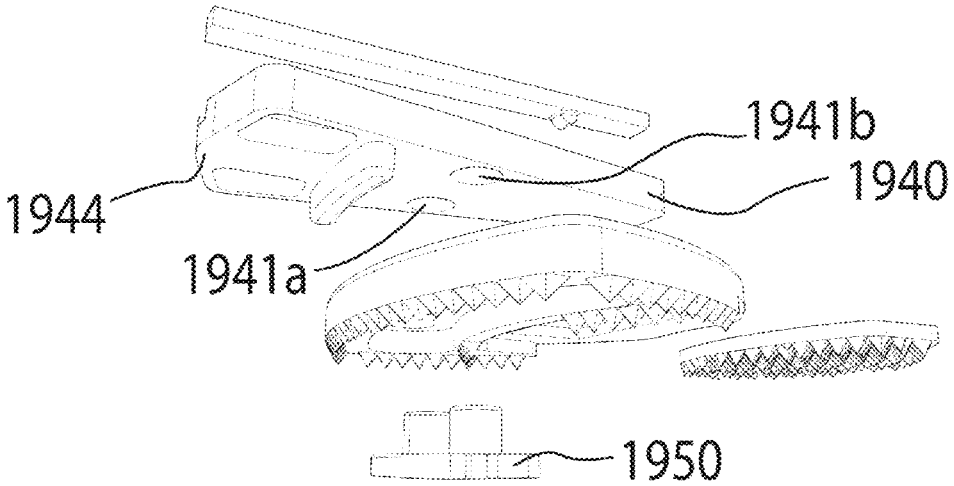
FIG. 20 illustrates an exploded view of the ball marker of FIG. 19.
Figure 21:
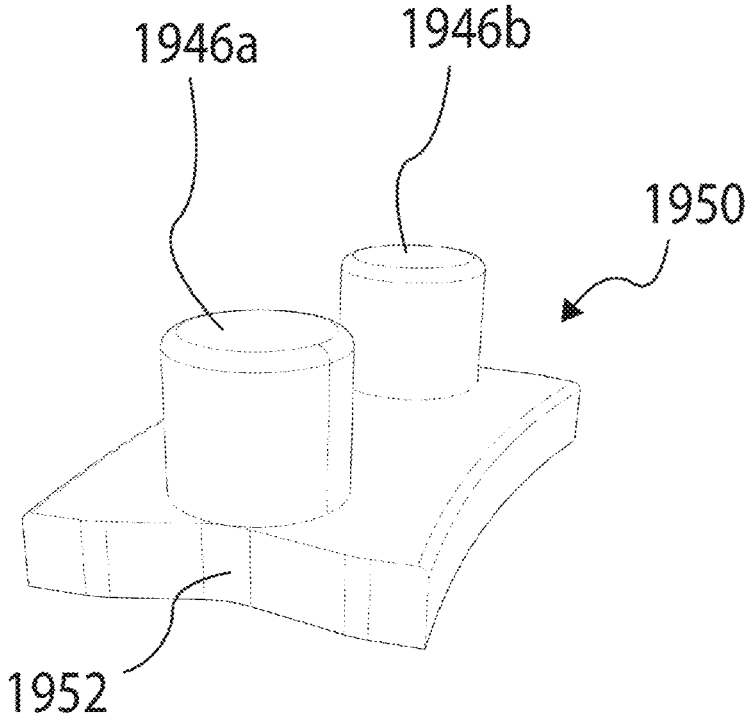
FIG. 21 illustrates the receiver of FIG. 19.

FIG. 19 shows a view of the bottom of an embodiment of a ball marker 1900, and an alternate receiver 1950. FIG. 20 shows an exploded view of ball marker 1900. FIG. 21 shows the receiver 1950. In the illustrated embodiment, the receiver 1950 may be integrated with one or more channel posts 1946*a*, 1946*b*. The receiver 1950 may have concave side surfaces 1952, which may reduce impedance from grass under the ball marker when the aiming device is moved on the arcuate path.

The direction arm 1940 may include receptacles 1941*a* and 1941*b* on the bottom surface 1944. The on or more channel posts 1946 may be inserted into the one or more receptacles 1941 to couple the direction arm to the integrated channel posts and receiver. In some embodiments, the direction arm 1940 may be detachable from the receiver 1950 rather than permanently affixed.

Figure 22A:
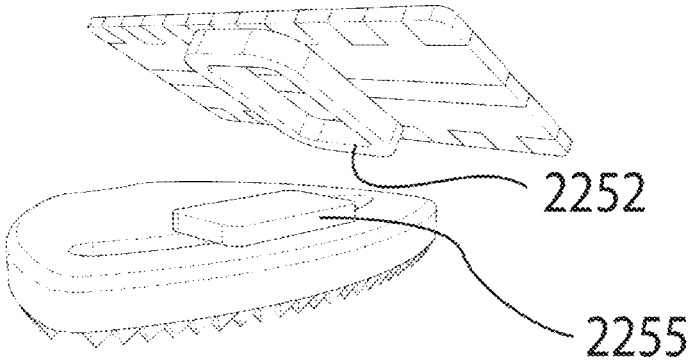
FIGS. 22A-B illustrate examples of a ball marker with a removable, interchangeable direction arm.
Figure 22B:
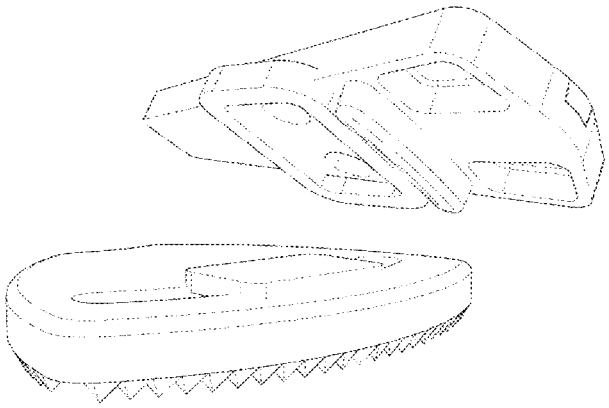

FIGS. 22A-B illustrate examples of a ball marker with a removable, interchangeable direction arm. The receiver and channel post assembly may include a top mounting surface 2255 that is operative to slide above the arcuate path. A direction arm may include a complementary mounting structure 2257 operative to snap onto or otherwise couple to the top mounting surface 2255. FIG. 22A shows a rectangularly shaped direction arm. FIG. 22B shows a kite-shaped direction arm. Other shapes are also within the scope of this disclosure, including, but not limited to, trapezoids, rhomboids, triangles, other polygons, or ellipses.

Figure 23A:
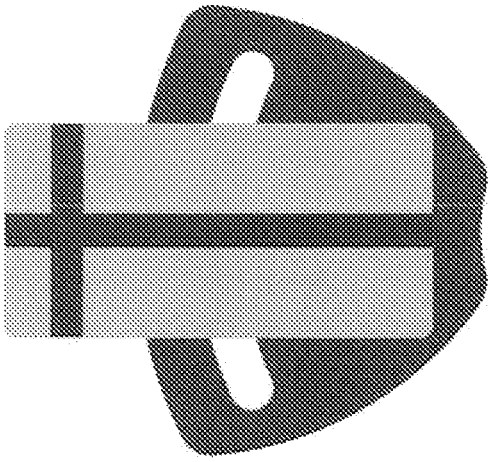
FIGS. 23A-C illustrate examples of linear indicators that may be used on a rectangular direction arm.
Figure 23B:
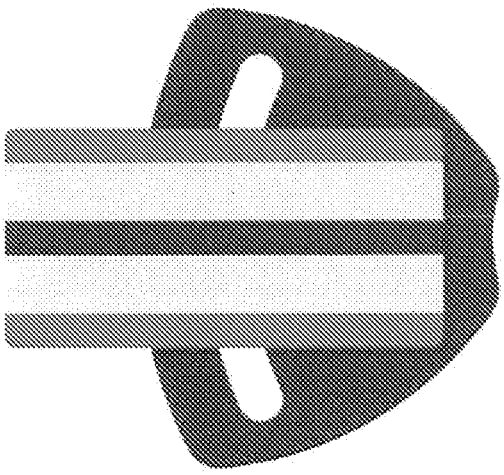
Figure 23C:
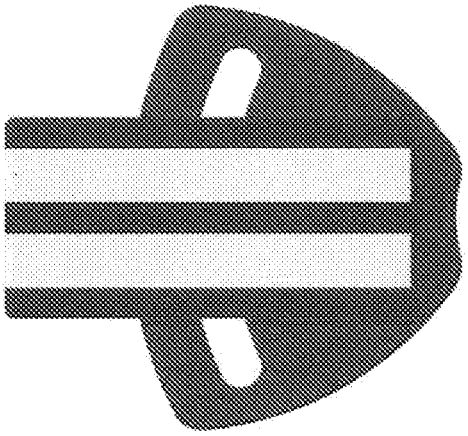

FIGS. 23A-C illustrate examples of linear indicators that may be used on a rectangular direction arm. FIG. 23A shows a linear indicator with a secondary perpendicular line in a crosshair arrangement. FIG. 23B shows two lines disposed on the outer edges of the direction arm and parallel to a central linear indicator line. Each outer line is separated from the central linear indicator line by a stripe of a contrasting color or finish. The outer lines may be a different color or finish than the central linear indicator. FIG. 23C shows an embodiment similar to that shown in FIG. 23B where the outer two lines have the same color and/or finish as the central linear indicator. In an embodiment, the direction arms shown in FIGS. 23A-C may be detachable and interchangeable on the aiming device.

Figure 24A:
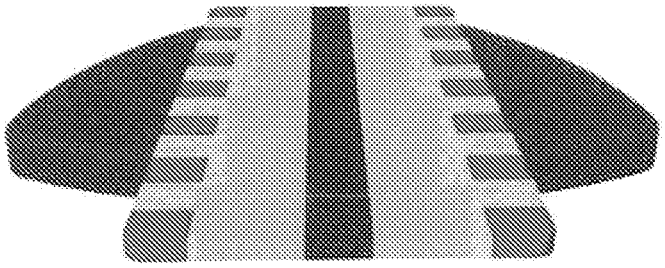
FIGS. 24A-B illustrate additional examples of linear indicators that may be used on a rectangular direction arm.
Figure 24B:
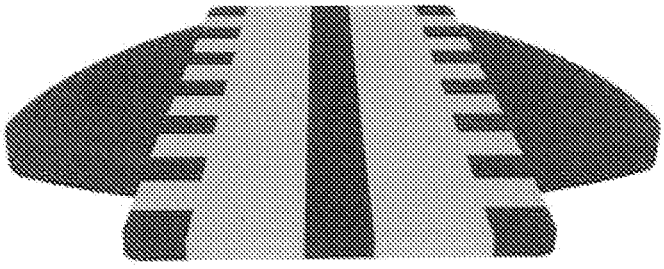

FIGS. 24A-B illustrate additional examples of linear indicators that may be used on a rectangular direction arm. FIG. 24A may represent a variant of the embodiment shown in FIG. 23B, where the outer two lines are replaced with dashed lines in a different color and/or finish from the solid central linear indicator. FIG. 24B may represent a variant of the embodiment shown in FIG. 23C, where the outer two lines are replaced with dashed lines of the same color and/or finish as the solid central linear indicator.

Figure 25:
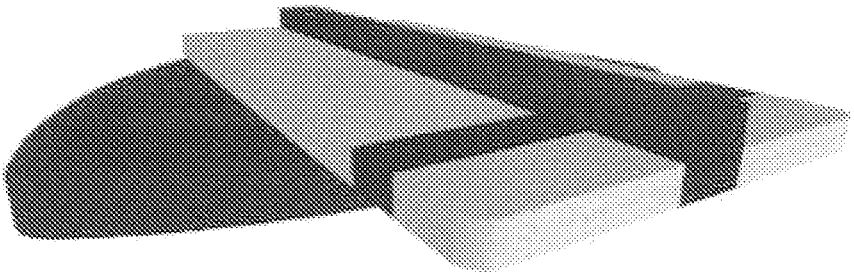
FIG. 25 illustrates an embodiment of a ball marker where the linear indicator is a raised stripe.

FIG. 25 illustrates an embodiment of a ball marker where the linear indicator is a raised stripe that protrudes above the top surface of the direction arm.

Figure 26A:
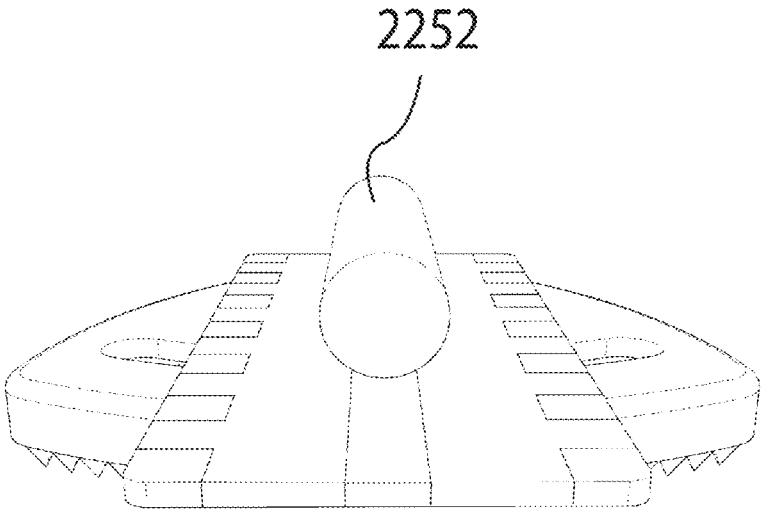
FIG. 26A illustrates an embodiment of a ball marker having a laser coupled to the direction arm.
Figure 26B:
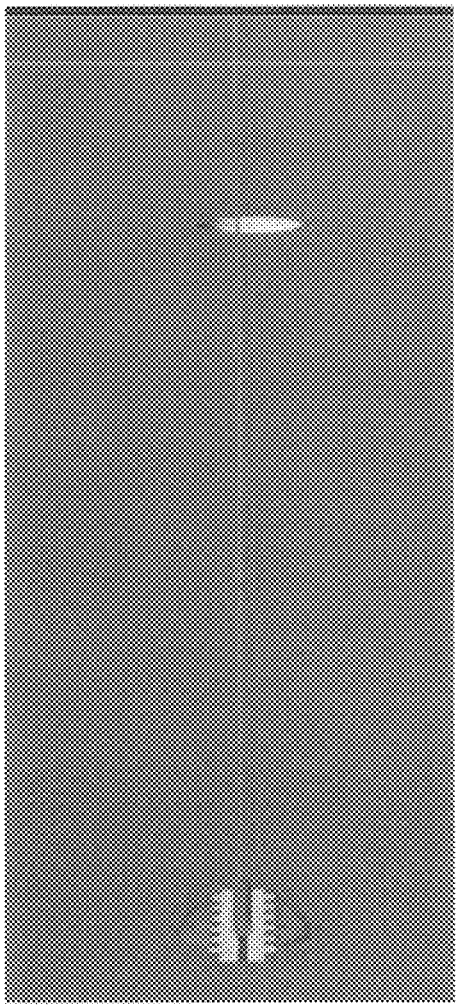
FIG. 26B illustrates an example of using the mounted laser of FIG. 26A to aid in selecting a target line and aligning the ball marker device.

FIG. 26A illustrates an embodiment of a ball marker having a laser 2602 coupled to the direction arm. The laser may be held in place in alignment with the linear indicator, for example, with a mechanical coupling, or with a magnetic coupling, and may be detachable. FIG. 26B illustrates an example of using the mounted laser to aid in selecting a target line and aligning the ball marker device. The use of a laser does not currently comply with the Rules.

FIGS. 27A-D illustrate views of a ball marker device 2700 having a tiltable direction arm. The direction arm may be coupled to a receiver and channel post assembly by a pivot coupling 2770. The axis of rotation of the pivot coupling may be orthogonal to the axis of rotation of the arcuate path and thus orthogonal to the linear indicator. A tiltable direction arm is not currently approved by the Rules.

Figure 27A:
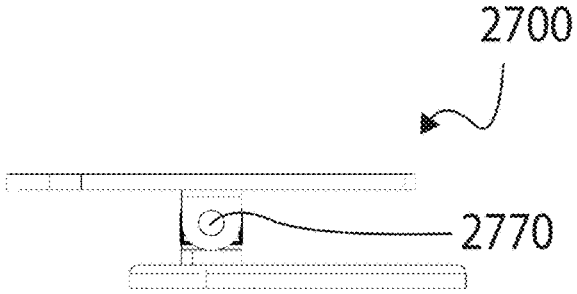
FIGS. 27A-D illustrate views of a ball marker device having a tiltable direction arm.
Figure 27B:
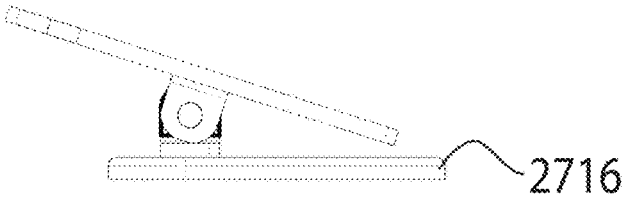
Figure 27C:
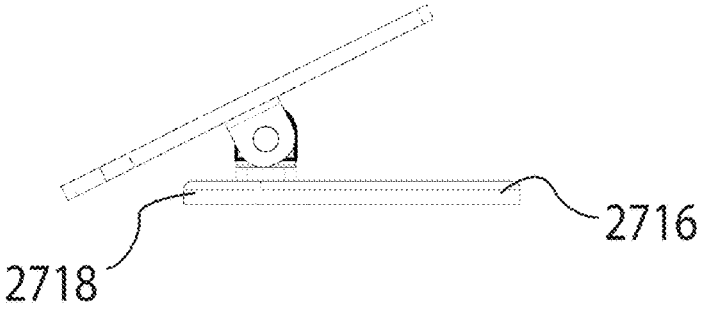
Figure 27D:
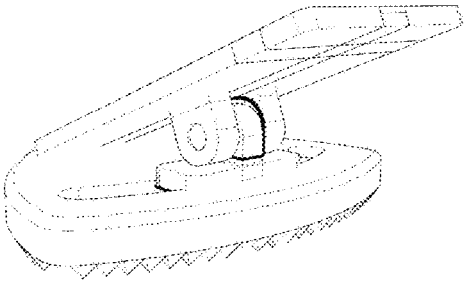

FIG. 27A shows the tiltable direction arm in a level configuration. FIG. 27B shows the tiltable direction arm tilted forward toward the ball contact surface 2716. FIG. 27C shows the tiltable direction arm tilted backward toward the back surface 2718. FIG. 27D shows an isometric view of the tiltable direction arm tilted forward toward the ball contact surface.

As used herein, "and/or" means "and" or "or", as well as "and" and "or." Moreover, any patent and non-patent literature cited herein is hereby incorporated by reference in its entirety for all purposes.

And, those of ordinary skill in the art will appreciate that the exemplary embodiments disclosed herein can be adapted to various configurations and/or uses without departing from the disclosed principles. Applying the principles disclosed herein, it is possible to provide a wide variety of combination golf ball marker and alignment devices, and methods of use. For example, the principles described above in connection with any particular example can be combined with the principles described in connection with another example described herein. Thus, all structural and functional equivalents to the features and method acts of the various embodiments described throughout the disclosure that are known or later come to be known to those of ordinary skill in the art are intended to be encompassed by the principles described and the features and acts claimed herein. Accordingly, neither the claims nor this detailed description shall be construed in a limiting sense, and following a review of this disclosure, those of ordinary skill in the art will appreciate the wide variety of combination golf ball marker and alignment devices, and methods of use that can be devised under disclosed and claimed concepts.

Moreover, nothing disclosed herein is intended to be dedicated to the public regardless of whether such disclosure is explicitly recited in the claims. To aid the Patent Office and any readers of any patent issued on this application in interpreting the claims appended hereto or otherwise presented throughout prosecution of this or any continuing patent application, applicants wish to note that they do not intend any claimed feature to be construed under or otherwise to invoke the provisions of 35 USC 112(f), unless the phrase "means for" or "step for" is explicitly used in the particular claim.

The appended claims are not intended to be limited to the embodiments shown herein, but are to be accorded the full scope consistent with the language of the claims, wherein reference to a feature in the singular, such as by use of the article "a" or "an" is not intended to mean "one and only one" unless specifically so stated, but rather "one or more".

Thus, in view of the many possible embodiments to which the disclosed principles can be applied, we reserve the right to claim any and all combinations of features and acts described herein, including the right to claim all that comes within the scope and spirit of the foregoing description, as well as the combinations recited, literally and equivalently, in any claims presented anytime throughout prosecution of this application or any application claiming benefit of or priority from this application, and more particularly but not exclusively in the claims appended hereto.

The invention claimed is:

1. A ball marker comprising:

a base comprising:

a top surface and an opposing bottom surface, a ball contact side, disposed on a sidewall between the top and bottom surfaces, having a shape configured to contact a spherical ball along a plurality of points defining a surface line of the ball that is orthogonally oriented with a vertical axis of the ball, the contact of the plurality of points being made simultaneously;

an opposing back side disposed between the top and bottom surfaces;

an aiming device, comprising a linear indicator, coupled to the base and configured to move along an arcuate path above the top surface, wherein when the ball contact surface is in fixed abutment against a ball, the arcuate path defines an axis of rotation with respect to the vertical axis of the spherical ball, and wherein the linear indicator remains radially oriented to the axis of rotation regardless of the position of the aiming device on the arcuate path;

wherein the base comprises an arcuate channel disposed between the ball contact side and the opposing back side, defining the arcuate path and the axis of rotation, the arcuate channel extending from the top surface toward the bottom surface, and wherein the aiming device is moveable within the arcuate channel;

wherein the aiming device comprises:

a direction arm having a radial length, wherein the linear indicator is disposed on a top surface of the direction arm along the radial length;

a channel post coupled to a bottom surface of the direction arm, wherein the channel post extends from the direction arm into the arcuate channel and is moveable therein; and a receiver coupled to the channel post and configured to permit the channel post to move in the arcuate channel and to prevent the aiming device from decoupling from the base.

2. The ball marker of claim 1, wherein the channel post is coupled to the direction arm at one end of the radial length.

3. The ball marker of claim 1, wherein the channel post is coupled to the direction arm at a position disposed away from an end of the radial length.

4. The ball marker of claim 3, wherein the channel post is coupled to the direction arm at a position in the middle of the radial length.

5. The ball marker of claim 1, wherein the arcuate channel extends completely through the base between the top and bottom surfaces of the base, wherein the channel post extends through the arcuate channel, and wherein the receiver is coupled to the channel post below the arcuate channel.

6. A ball marker comprising:

a base comprising:

a top surface and an opposing bottom surface, a ball contact side, disposed on a sidewall between the top and bottom surfaces, having a shape configured to contact a spherical ball along a plurality of points defining a surface line of the ball that is orthogonally oriented with a vertical axis of the ball, the contact of the plurality of points being made simultaneously;

an opposing back side disposed between the top and bottom surfaces;

an aiming device, comprising a linear indicator, coupled to the base and configured to move along an arcuate path above the top surface, wherein when the ball contact surface is in fixed abutment against a ball, the arcuate path defines an axis of rotation with respect to the vertical axis of the spherical ball, and wherein the linear indicator remains radially oriented to the axis of rotation regardless of the position of the aiming device on the arcuate path; and wherein the ball contact side has a concave shape, the ball contact side having a curvature that matches a curvature on a standard golf ball and can engage the golf ball's curvature in a complementary abutment.

7. The ball marker of claim 6, wherein the bottom surface of the base comprises one or more traction elements configured to, at least one of: increase friction with a ground surface when the bottom surface contacts the ground surface, or detachably affix the ball marker to the ground surface.

8. The ball marker of claim 6, wherein the opposing back side of the base is curved and has the same axis of rotation as the arcuate path, and wherein the aiming device further comprises a curve guide flange that extends from a bottom surface of the aiming device and is configured to move with respect to an outside of the opposing back side of the base when the aiming device is moved along the arcuate path.

9. The ball marker of claim 6, wherein the ball contact side is curved and defines an axis of rotation that is the same as the axis of rotation of the arcuate path.

10. The ball marker of claim 6, wherein the base further comprises a textured component disposed on the bottom surface of the base and removably attachable to the bottom surface of the base, the textured component having at least one textured surface.

11. The ball marker of claim 10, wherein the textured component is a second ball marker.

12. The ball marker of claim 11, wherein the textured component comprises a second ball contact side having a shape configured to contact a spherical ball along a surface line of the ball.

13. The ball marker of claim 10, wherein the bottom surface of the base comprises a recess configured to house the textured component such that, when the ball marker device is placed on a playing surface, the textured surface contacts the playing surface.

14. The ball marker of claim 13, wherein the recess comprises an open side configured to permit the textured component to be slid in and out of the recess through the open side.

15. A ball marker comprising:

a base comprising:

a top surface and an opposing bottom surface, a ball contact side, disposed on a sidewall between the top and bottom surfaces, having a shape configured to contact a spherical ball along a plurality of points defining a surface line of the ball that is orthogonally oriented with a vertical axis of the ball, the contact of the plurality of points being made simultaneously, an opposing back side disposed between the top and bottom surfaces; and an aiming device, comprising a linear indicator, coupled to the base and configured to move along an arcuate path above the top surface, wherein when the ball contact surface is in fixed abutment against a ball, the arcuate path defines an axis of rotation with respect to the vertical axis of the spherical ball, and wherein the linear indicator remains radially oriented to the axis of rotation regardless of the position of the aiming device on the arcuate path;

wherein the aiming device is configured not to contact the ball when the ball is in contact with the ball contact side.

16. The ball marker of claim 6, wherein the aiming device further comprises a pitch mark repair tool.

17. The ball marker of claim 6, wherein the ball contact side is configured to contact a standard golf ball.

18. A method of making a ball marker, comprising:

providing a base comprising a top surface and an opposing bottom surface; a ball contact side, disposed on a sidewall between the top and bottom surfaces, having a shape configured to contact a spherical ball at two or more positions on the ball; and an opposing back side disposed between the top and bottom surfaces, the contact of the two or more points with the ball contact side being made simultaneously;

providing an aiming device comprising a direction arm and a linear indicator disposed on a top surface of the direction arm;

coupling the aiming device to the base, wherein the coupled aiming device is configured to move along an arcuate path above the top surface of the base, wherein when the ball contact surface is in fixed abutment against a ball, the arc defines an axis of rotation with respect to the vertical axis of the spherical ball, and wherein the linear indicator remains radially oriented to the axis of rotation regardless of the position of the aiming device on the arcuate path; and wherein the ball contact side has a concave shape, the ball contact side having a curvature that matches a curvature on a standard golf ball and can engage the golf ball's curvature in a complementary abutment.

* * * * *